US009826806B2

(12) United States Patent
Challa

(10) Patent No.: US 9,826,806 B2
(45) Date of Patent: Nov. 28, 2017

(54) ASSISTIVE SUPPORT SYSTEMS AND DEVICES FOR AUTOMATIC FEEDBACK

(71) Applicant: Pranav Challa, Clearwater, FL (US)

(72) Inventor: Pranav Challa, Clearwater, FL (US)

( * ) Notice: Subject to any disclaimer, the term of this patent is extended or adjusted under 35 U.S.C. 154(b) by 0 days.

(21) Appl. No.: 14/936,668

(22) Filed: Nov. 9, 2015

(65) Prior Publication Data

US 2017/0224573 A1 Aug. 10, 2017

Related U.S. Application Data

(63) Continuation of application No. 62/077,356, filed on Nov. 10, 2014.

(51) Int. Cl.

| | |
|---|---|
| ***A45B 9/02*** | (2006.01) |
| ***A45B 9/04*** | (2006.01) |
| ***A45B 3/00*** | (2006.01) |
| ***A45B 3/02*** | (2006.01) |
| ***A45B 3/04*** | (2006.01) |
| ***A45B 3/08*** | (2006.01) |
| ***A61H 3/02*** | (2006.01) |
| *A61H 3/06* | (2006.01) |

(52) U.S. Cl.

CPC ..... *A45B 9/02* (2013.01); *A45B 3/00* (2013.01); *A45B 3/02* (2013.01); *A45B 3/04* (2013.01); *A45B 3/08* (2013.01); *A45B 9/04* (2013.01); *A61H 3/02* (2013.01); *A61H 3/061* (2013.01); *A61H 2003/063* (2013.01); *A61H 2201/0188* (2013.01); *A61H 2201/0192* (2013.01); *A61H 2201/0207* (2013.01); *A61H 2201/0214* (2013.01); *A61H 2201/5007* (2013.01); *A61H 2201/5012* (2013.01); *A61H 2201/5043* (2013.01); *A61H 2201/5048* (2013.01); *A61H 2201/5058* (2013.01); *A61H 2201/5061* (2013.01); *A61H 2201/5064* (2013.01); *A61H 2201/5082* (2013.01); *A61H 2201/5084* (2013.01); *A61H 2201/5092* (2013.01); *A61H 2201/5097* (2013.01); *A61H 2230/06* (2013.01); *A61H 2230/08* (2013.01); *A61H 2230/60* (2013.01)

(58) Field of Classification Search

CPC .... A45B 9/02; A45B 9/04; A45B 3/00; A45B 3/02; A45B 3/04; A45B 3/08

See application file for complete search history.

(56) References Cited

U.S. PATENT DOCUMENTS

| | | | | |
|---|---|---|---|---|
| 7,918,237 | B1 * | 4/2011 | Kuo | A61H 3/02 135/65 |
| 2013/0346021 | A1 * | 12/2013 | Stevens | A45B 3/00 702/160 |
| 2017/0172462 | A1 * | 6/2017 | Alghazi | A61B 5/11 |

* cited by examiner

*Primary Examiner* — Leon Flores

(57) ABSTRACT

In accordance with one or more embodiments and corresponding disclosure, various non-limiting systems, devices, and methods are described in connection with an assistive support device that provides feedback to a user. In an aspect, disclosed is a system comprising, a first sensor component that generates a first set of sensor data based on a first set of force applied to an assistive support device. The system also comprises a data repository component that stores a first set of sensor data provided by the assistive support device. Furthermore, in an aspect, the system comprises a feedback component that employs a feedback mechanism based on an occurrence of a value of an applied force to the assistive support device of the first set of force applied being greater than or less than a threshold value of an applied force.

20 Claims, 12 Drawing Sheets

ASSISTIVE SUPPORT SYSTEMS AND DEVICES FOR AUTOMATIC FEEDBACK

CLAIM OF PRIORITY UNDER 35 U.S.C. §119

This application claims priority to U.S. Provisional Patent Application No. 62/077,356, entitled "CANE SYSTEMS AND DEVICES FOR AUTOMATIC PATIENT FEEDBACK", and filed on Nov. 10, 2014, the entirety of which is herein incorporated by reference.

TECHNICAL FIELD

This disclosure generally relates to systems and devices that facilitate information feedback to users of an assistive support device.

BACKGROUND

When a person sustains a lower extremity injury, such as a hip injury, recovery from the injury often requires physical therapy. An aspect of physical therapy involves applying proper amounts of force through the injured limb. If force is applied in excess, re-injury of the limb is possible; however, if the injured limb is not subjected to adequate force, recovery time is extended. In a physical therapy session, the patient works with a trained technician or physician to ensure proper forces are being transmitted through the injured limb.

This is done through various measures and the use of various tools including, but not limited to: weight bearing harnesses, force plates embedded in the ground, and the mathematical analyses of images, information, and other feedback provided by the measures. For example, weight bearing harnesses apply upward forces on the torso or pelvis of the patient thereby limiting or minimizing forces through the legs. Based on relevant analysis and the application of different upward forces through the harness, the technician or physician can carefully and accurately distribute the proper amount of weight through the patient's injured limb. Similarly, force plates embedded in the ground provide live feedback to the technician of the amount of weight applied by the patient in each leg.

Both of these methods require training the patient to learn and comprehend by muscle memory the correct amount of force to apply through the leg. However, outside of physical therapy sessions, the patient lacks feedback or instrumentation to determine if the correct amount of weight is being applied through each leg or injured limb. In the absence of a feedback instrument, the patient may apply an excessive or otherwise inappropriate amount of force, which can potentially cause further problems or complications.

SUMMARY

The following presents a simplified summary of the disclosure in order to provide a basic understanding of some aspects of the disclosure. This summary is not an extensive overview of the disclosure. It is intended to neither identify key or critical elements of the disclosure nor delineate any scope particular embodiments of the disclosure, or any scope of the claims. Its sole purpose is to present some concepts of the disclosure in a simplified form as a prelude to the more detailed description that is presented later.

In accordance with one or more embodiments and the corresponding disclosure, various non-limiting aspects are described in connection with a digital assistive support device that automatically provides information feedback to a patient related to use of assistive support devices, systems, and methods. In accordance with a non-limiting embodiment, in an aspect, a system is provided comprising a processor, communicatively coupled to a memory, that executes or facilitates execution of executable components stored in a non-transitory computer readable medium, the executable components comprising: a first sensor component that generates a first set of sensor data based on a first set of force applied to an assistive support device; a data repository component that stores a first set of sensor data provided by the assistive support device; and a feedback component that employs a feedback mechanism based on an occurrence of a value of an applied force to the assistive support device of the first set of force applied being greater than or less than a threshold value of an applied force.

In various aspects, the system further comprises, a second sensor component that generates a second set of sensor data comprising a set of temperature measurements or a set of environmental pressure measurements. In another aspect, the system can comprise an accelerometer component that detects an orientation of the assistive support device or a corresponding angle of impact of an object that applies force to the assistive support device. Furthermore, in an aspect, the system can comprise an analysis component that generates a set of user data comprising hand grip data, pulse data, heart rate data, and other biometric data.

The disclosure further discloses a method, comprising generating, by a system comprising a processor, a first set of sensor data based on a first set of force applied to an assistive support device; storing, by the system, a first set of sensor data provided by the assistive support device; and employing a feedback mechanism based on an occurrence of a value of an applied force to the assistive support device of the first set of force applied being greater than or less than a threshold value of an applied force.

In yet another aspect, disclosed is a device comprising a base element extending from a bottom portion of a shaft, wherein the base element comprises a first set of sensors that detects a first set of data representing a first set of force values applied to the base element of the device; a transmission component that transmits the first set of data to a microcontroller element; and a handle element extending from a top portion of the shaft, wherein the handle element comprises the microcontroller element that analyzes the transmission component.

The following description and the annexed drawings set forth certain illustrative aspects of the disclosure. These aspects are indicative, however, of but a few of the various ways in which the principles of the disclosure may be employed. Other advantages and novel features of the disclosure will become apparent from the following detailed description of the disclosure when considered in conjunction with the drawings.

DETAILED DESCRIPTION

Overview

Figure 1:
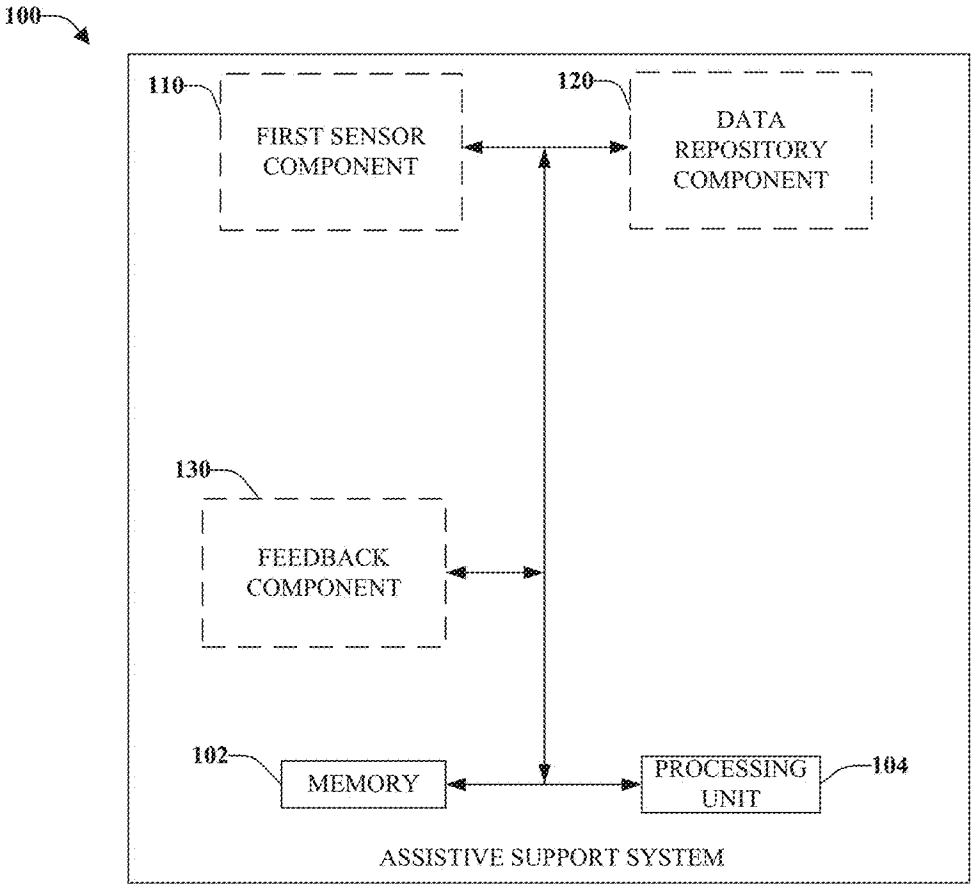
FIG. 1 illustrates an example non-limiting exemplary system for providing feedback related to using an assistive support device.

The innovation is now described with reference to the drawings, wherein like reference numerals are used to refer to like elements throughout. In the following description, for purposes of explanation, numerous specific details are set forth in order to provide a thorough understanding of this innovation. It may be evident, however, that the innovation can be practiced without these specific details. In other instances, well-known structures and devices are shown in block diagram form in order to facilitate describing the innovation.

By way of introduction, the subject matter disclosed in this disclosure relates to assistive support devices, systems and methods (e.g., cane, crutches, walking stick, etc.) to provide feedback information to users (e.g., patients). An increasing number of people require walking aids or assistive support devices to maintain mobility. As such, the use of assistive support devices requires various pressure and forces to be applied to the device as well as the user. For instance, a user with a hip fracture may use a cane to help restore their gait, however contact pressures can be applied by the user throughout the body that can be detrimental to a persons metabolic and musculoskeletal system. Thus, the assistive devices, rather than improving a user's support, balance, and activity, can instead exacerbate the injury or pain.

An assistive support device should redistribute weight and pressure away from a lower extremity of a person (e.g., the hip) and improve a patients weakened support structure by improving stability at the patients' base. Furthermore, a proper assistive device that is used properly can support a patients' weight. For instance, a patient that properly uses a cane will hold the cane contralateral to a weak lower extremity while simultaneously advancing with the contralateral leg. Thus it is important for a patient to be aware and cognizant of their usage in real time. Furthermore, a patient should use an assistive support device with appropriate dimensions such as correct height, fit, and proper maintenance to obtain the maximum benefit from its use. By understanding the usage of an assistive support device (e.g., via usage feedback, walking pattern data, force data, etc.) a patient or physician can understand whether the patient needs to make adjustments to their assistive support device.

The disclosed systems, methods, and devices comprise a digital assistive device that provides various feedback information and data to a device user in order to ensure a person is using the assistive support device properly, provide meaningful information to facilitate effective treatment of the injury, ensure the dimensions of the device are appropriately customized to the needs of a particular user, identify tactile information about the environmental surroundings (e.g., whether the ground is rough terrain, a road, etc.), identify the forces applied to the device at various positions (e.g., too much pressure is applied at the base of a cane and at an odd angle), and provide other such useful information (e.g., temperature and pressure data, number of steps taken, weight distribution data, force applied to the device, etc.).

Example System of Cane Device with Automatic Feedback

Embodiments and examples are described below with reference to the drawings, wherein like reference numerals are used to refer to like elements throughout. In the following description, for purposes of explanation, numerous specific details in the form of examples are set forth in order to provide a thorough understanding of the various embodiments. It will be evident, however, that these specific details are not necessary to the practice of such embodiments. In other instances, well-known structures and devices are shown in block diagram form in order to facilitate description of the various embodiments.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

As utilized herein, terms "component," "system," "interface," and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer within a device (e.g., a digital cane) and/or distributed between two or more computers.

Further, these components can execute from various computer readable media having various data structures stored thereon such as with a module, for example. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements. The word "set" is also intended to mean "one or more."

Referring now to the drawings, with reference initially to FIG. 1, assistive support system 100 is shown that facilitates providing feedback information to a patient. In an aspect, system 100 comprises a memory 102 that stores computer executable components; a processor 104 that executes at least the following computer executable components stored in the memory 102: a first sensor component 110 that generates a first set of sensor data based on a first set of force applied to an assistive support device; a data repository component 120 that stores a first set of sensor data provided by the assistive support device; and a feedback component 130 that employs a feedback mechanism based on an occurrence of a value of an applied force to the assistive support device of the first set of force applied being greater than a threshold value of an applied force.

The assistive support system 100 can comprise sensing elements and data collection hardware to generate and receive assistive support device usage pattern data (e.g., movement data). In an aspect system 100 can utilize its hardware and software elements to relay data to a remote center (in addition to its local data repository). Furthermore, support system 100 can utilize data analysis techniques to extract clinically relevant information from the usage pattern data. In an aspect, system 100 employs first sensor component 110 that generates a first set of sensor data based on a first set of force applied to an assistive support device. In an aspect, an assistive support device can comprise any one or more of a cane (e.g., single, tip cane, flex stick tri-tip cane, quad cane, etc.), crutch (e.g., crutch comprising a crutch pad, hand grip element, adjustable crutch leg, crutch tip, etc.), walker or other such walking aid (e.g., forearm crutch comprising a forearm collar, handgrip element, anti rattle collar, tip, etc.).

The assistive support device comprises electrical circuitry and hardware to enable digital feedback of information to a user. The assistive support device employs the assistive support system to provide feedback information to a user. Furthermore, the assistive support device comprises a sensor that can detect force applied to various regions of the assistive support device. For instance, where an assistive support device is a cane, the sensor can be located at the base of the cane, such that when pressure is applied at the cane base, the sensor will detect such applied force. Furthermore, the sensor can employ a force collector to measure the strain or applied force over an area (e.g., such as the cane base). In an aspect, the sensor can be a one or more load cell, strain gauge load cell, or tactile pressure sensor (e.g., detecting and measuring a point contact force to measure pressure and torque).

In another aspect, the sensor can measure various parameters such as orientation, force, rotation, temperature, normal and shear forces, vibrations, slip, torque, motion, strain, impact signals, and other such parameters. The sensor can also identify the position of all applied forces using an array sensor, which has vertical and horizontal piezoresistive traces. The sensor can be connected to an electrical system, such that when force is applied to the sensor (e.g., a variable resistor portion of the sensor), a change to the sensor will lead to current flowing through first sensor component 110, such that the electronics will collect the resulting data based on the electrical signal.

The first sensor component 110 can detect pressure and collect dynamic sensing data (e.g., dynamic measurements of interface pressure between an object and the sensor) based on the applied pressure. For instance, a sensor located in the handle of a digital cane can detect pressure applied by a users handle and downward force applied to the handle at various positions. Thus, a user may apply different levels of pressure to the cane handle while standing as opposed to during ambulation. As such first sensor component 110 can detect and collect such pressure variations and generate information about use patterns associated with the cane. In another aspect, a sensor at the base of the cane can detect pressure applied to the cane base (through the shaft and handle).

As such the pressure between the ground and the cane base can provide data and insight as to the center of pressure applied to the cane for a patient standing and walking. Furthermore, such data and the differences between forces applied to the handle and base as well as variations in each respective force can indicate a patient's stability (e.g., while walking or standing) while using the cane. The stability information can be used to determine a patient's risk of falling and is capable of being used to predict the chance of falling given a particular force pattern or force scenario.

Furthermore, the sensor elements are capable of calibration to provide more accurate data, and the accuracy of such data increases with an increased frequency in use of the assistive support device (e.g., a calibration curve with a greater number of data points can be generated). In an aspect, first sensor component 110 can comprise sensors located throughout the assistive support device that collect sensor data from multiple contact points. For instance, an assistive support device that is a cane can comprise sensors (e.g., force sensor, pressure sensor, tactile sensor, etc.) located within the cane handle (e.g., to measure a users grip or grasp of the handle, stabilizing forces at the hand to compensate for postural-based or weight-based imbalances, etc.), the cane body or shaft (e.g., to measure the vertical force through the cane length) and at the cane base.

In yet another non-limiting embodiment, first sensor component 110 can communicate with sensors placed on the body of a patient (e.g., wearable sensors) as well. For instance, a user of a cane can receive sensed data from the sensors on the cane, but such data can be integrated with sensors located on the users body (e.g., remote monitoring systems to gather physiological and movement data of a patient) to sense gait changes. A sensor worn below the knee (e.g., a cuff) or a sensor in a patients' shoe can detect changes to the patients' foot while walking. A leg cuff can send a signal to the patient (e.g., via electrical stimulation), such as to specific leg muscles or nerves of the patient, to assist a user in walking more naturally.

In another aspect, the remote monitoring by a patient using first sensor component 110 or a combination of first sensor component 110 with wearable sensors provides self-management, medical practitioner management, provider management of specific behaviors and exercises for self-management of health conditions and assistive support device usage patterns. Thus remote monitoring or potential sources of dangers such as an improper imposition of weight on the device or the prospect of a patient falling from improper use of the device can be monitored to mitigate such events from taking place.

Furthermore, wearable sensors in combination with data from the assistive support device can be used to implement real time behavioral modifications by a patient (e.g., correcting a patient's posture, distribution of weight applied to the device, nature of gait when utilizing the device, etc.). For instance, an electromyogram signal (or surface EMG signal) can be received by first sensor component 110 to indicate an electrical manifestation of a contracting muscle to measure different gates, facilitate the generation of kinematic plots of gait characteristics. The combination between use pattern data related to usage of the device and gait characteristic data can provide significant training feedback data and facilitate a continuing determination of treatment courses to provide based on such data. In another aspect, first sensor component 110 can generate data from pressure sensors mounted on the user to measure user details such as foot plantar pressure distribution, gait phase detection, and other such significant data to incorporate with usage pattern data.

In an aspect, first sensor component 110 can generate data from other non-force related sensors as well. For instance, sensor data can be generated from an accelerometer (e.g., 3-axis accelerometer, MEMS accelerometers, etc.) to measure modes of acceleration and translational movement (e.g., acceleration, vibration, shock, tilt, rotation, position, orientation, etc.). In another aspect, first sensor component 110 can generate sensor data from gyroscopes (e.g., to determine directional accuracy) and/or magnetometers to improve motion tracking of the device. First sensor component 110 can generate data from any one or more of a variety of gyroscopes (e.g., MEMS gyroscope, fiber optic gyroscope, hemispherical resonator gyroscope, vibrating structure gyroscope, dynamically tuned gyroscope, ring laser gyroscope) or accelerometer (e.g., free-fall sensor, etc.).

Given that first sensor component 110 can generate data from a variety of sensors, the generated sensor data in connection with use of the assistive support device is also diverse in nature and meaning. For instance, an accelerometer sensor or gyroscope sensor can be used for movement detection, movement tracking, and/or calculating and detecting the position, orientation, and velocity of the assistive support device or user relative to the device. Furthermore, global positioning data (e.g., via GPS sensors) can detect the location and movement of the assistive support device. Furthermore, in an aspect, a free-fall sensor can generate data that indicates whether the assistive support device (e.g., and inferentially the user) has been dropped or fallen. First sensor component 110 can also generate data from a pedometer that measures the number of steps a user takes.

This type of data coupled with information related to the degree of compliance or non-compliance of a patients use of the assistive support device can provide insight as to with what frequency and distance a patient uses the assistive support device in an incorrect manner. A GPS monitor can be used to combine fall detection aspects of the device with localization data to determine where a user or patient may have fallen while using the device. Furthermore, a warning about the fall and the location of the user can be transmitted to a person of interest such as a family member, caregiver. A detection of stoppage of movement of the device as well (e.g., over a period of time) can indicate the likelihood that a potential fall has taken place by a user especially for a user with a history of frequently falling.

In an aspect, first sensor component 110 can generate data that tracks the orientation, motion, and rotational forces of the assistive support device. Furthermore, other data can track a patient's pattern of usage of the device. Also, the data can be used to generate feedback to be used by the patient, physician, healthcare provider or payer. For instance, a user can generate information as to the distance traveled over a period of time, the speed of movement (e.g., slow walk, fast walk, etc.), the amount and degree to which a patient turns during such movement (e.g., 45 degree turns, 180 degree turns, etc.), the load applied to the assistive support device, the duration of time holding the device, the heart rate over a period of time, kinematic data, gait analysis data, moment data, and other such data.

A sensor based in the handle of the assistive support device can provide data to first sensor component 110, wherein such data indicates values associated with the patients' balance, instability, potential weaknesses in legs or trunks, positioning of the device in reference to the patients stride, or the amount of body weight carried by each leg (e.g., injured leg or healthy leg) while using the device. For example, a patient should position a cane ahead of them by a small stride and step forward with the injured leg (such that the healthy leg bears the patients' bodyweight along with the cane). The data can identify whether the patient is using the assistive support device (e.g., a cane) in the proper manner as to expedite their recovery rather than exacerbate the injury. The data can also provide physicians and therapists with feedback to facilitate treatment and training using the cane.

For instance, a patient should hold the cane with the hand opposite the injured limb when climbing up and down stairs. Furthermore, the patient should walk up steps with the healthy leg first then the injured leg and subsequently the cane. Conversely, the patient should place the cane on a lower step first, when walking down steps, followed by the injured leg and subsequently the healthy leg. Thus, where the assistive support device 110 generates force data from the cane handle and the cane base that indicates weight distribution patterns correlated with a particular use pattern (e.g., order of injured leg, healthy leg, cane use for walking), such data can be used to assist a physician in suggesting modifications in use of a cane to a patient.

In scenario's where the assistive support device is a walker, the data should facilitate similar feedback. For instance, the legs of the walker should be level with the ground to provide proper stability, and sensors located at the base of each walker leg can collectively provide data to determine whether the walker is level at particular moments in time. Furthermore, in an aspect, sensors placed on the handles of the walker can measure biaxial forces applied by the user on each handle of the walker in order to provide guidance information (e.g., to the user or healthcare provider). In another aspect, whereby the assistive support device is a pair of crutches, the data can provide various insights as to the patients' patterns for walking, stepping up, or stepping down stairs. In another aspect, the data can account for ground reaction forces when providing feedback such as estimations of net moments at the ankle, knee, and hip joints. Furthermore, the assistive support device can use generated (e.g., via first sensor component 110) data to predict a users' behavior (e.g., the likelihood of a patient to fall).

In an aspect, system 100 also employs a data repository component 120 that stores a first set of sensor data provided by the assistive support device. In an aspect, data repository 120 stores data generated by first sensor component 120 locally or remotely (e.g., via Bluetooth or wireless communication with an external data repository such as a server). The stored data can also integrate a variety of personal information, social data, and transactional information to facilitate generation of meaningful feedback to a user. For instance, a user can input demographic information such as age, sex, weight, body length measurements, or height to correlate walking pattern and force pattern data with standardized data for users of the same age or sex. In another aspect, a user can input location information (e.g., destination information, starting point information, route traveled, etc.) to analyze or correlate data associated with walking a certain route with force pattern data and walking pattern data at various moments along such route. Thus, a steep incline on a path may help explain a spike in applied force, and angled pressure applied to the assistive support device. Furthermore, a suggestion as to a proper route can be provided to a user based on the levels of force that should be imposed on the device to facilitate proper use of the device to facilitate the best treatment.

In another aspect, data repository component 120 can be employed to store information (e.g., force data, feedback data, and other such data associated with the device, etc.) local to the assistive support device. In another aspect, one or more servers can be operatively connected to the data repository component 120 (e.g., via server store(s)) to store information local to the servers. In one embodiment, the assistive support device (e.g., using data repository 120) can transfer data or information to a server. The server can store the file, decode the file (if needed), or transmit the file to another device or server. The device (e.g., using data repository 120) can also compress data or encode data to prepare the data for transmission. Furthermore, in another aspect, data repository 120 can include or have access to information related to actions or activity of users of the assistive support device and control settings that respective users have implemented in association with their device activity or usage.

In yet another aspect, system 100 employs a feedback component 130 that employs a feedback mechanism based on an occurrence of a value of an applied force to the assistive support device of the first set of force applied being greater than a threshold value of an applied force. A feedback mechanism is a mechanism to provide a user any one or more form of sensory feedback (e.g., visual feedback, auditory feedback, or tactile feedback, etc.), such as providing an acoustic, speech, or tactile output. For instance, a user can utilize the assistive support device such as a cane and apply too much weight to the handle or distribute their weight incorrectly throughout the cane. In response to a non-compliant use of the cane by the user, the feedback mechanism can perform a vibrate, a pulsed vibration, an illumination of an indicator light, or a blinking of an indicator light to notify the user of such non-compliant usage. Furthermore, in an aspect, different colored lights (e.g., LED's) can be used to indicate the occurrence of different events related to device usage patterns. For instance, luminescence of a blue LED can indicate that a force less than a specified threshold is being exerted on the device. In another aspect, luminescence of a green LED can indicate that the device is travelling on a recommended travel route. Thus various light colors can indicate different aspects of device use.

In another aspect, the feedback mechanism can be kinesthetic feedback, such as an active or resistive force feedback. For instance, a cane can provide an opposing force (e.g., using a coil, spring, tense material, located at the base of the cane) in order to facilitate the patients' proper use of the cane (in addition to a force sensor). In another aspect, the feedback mechanism can be a tactile feedback mechanism such as providing a vibration to the handle of the cane, or applying a textured material to parts of the device to indicate non-compliant usage of the device. For instance, if a user improperly grips a portion of the cane handle they can feel a textured material that is different from a material located at portions of the cane that facilitate a proper grip. In another aspect, a vibrational effect or vibrotactile effect can provide cues to the user via electronic device employed by the device that alerts the user of the occurrence or non-occurrence of a particular event (e.g., applying too much or too little force to the cane). Furthermore, in an aspect, a sensory application, such as the application of heat or cold temperature to the handle of the cane can be used to provide feedback to a user as well.

In another aspect, the feedback mechanism can make use of visual data to present a representation of data to indicate various use patterns or health parameters associated with use of the assistive support device. For instance, the feedback mechanism in connection with a display monitor (e.g., LED screen) can present usage pattern data such as distance traveled, forces exerted on the device, distribution of weight and load on the device, heart rate of a user, and other such information to be displayed on a monitor employed by the device (e.g., internal to the device or external to the device). Furthermore, a physician can also use the feedback information to make determinations about the patient care and assess biomechanical information such as the strength of the patient dorsiflexors, the presence of hip hiking, hip abductor strength, hip circumduction, presence of ataxic or antalgic gait, presence of vaulting, inadequate patient balance, muscle weakness or paralysis of particular body parts.

In response to the data, the patient and/or physician can implement additional training exercises to compensate for issues associated with a patients' usage of the device (e.g., decreasing weight bearing on one of the lower extremities, coordinate the strengthening of the upper extremities with the lower extremities, increase trunk strength for use of crutches, switch to use of a multi-legged cane, etc.), perform ambulation training, perform gait training, and other such exercises. Furthermore, the cane dimensions can be adjusted to increase or decrease the height (e.g., collapse the length of the shaft) of device components to address some of the data feedback issues. The data can further determine the degree of flexion of the elbows while holding a device, the angle of the hand grip, the amount of weight borne on a lower extremity during standing versus ambulation, distribution of weight (e.g., weight born on the hands to compensate for weight not born by the involved lower extremity) and other such determinations.

In another aspect, the feedback mechanism can determine the proper gait speed of a patient to provide maximum stability while using the device. The feedback can also indicate various gait patterns taking effect (e.g., via use of the force sensors, accelerometer, and gyroscope embedded in the device using system 100). For instance, a four-point gait pattern by a user of crutches is characterized by the advancement of a right crutch, then left foot, left crutch, then right foot and provides maximum stability for a patient using a slow gait speed. Thus, if the feedback indicates the gait speed is too high, then feedback component 130 can indicate (e.g., via a vibration) such increased speed to the user.

In addition to providing feedback, feedback component 130 can employ the feedback mechanism in response to the occurrence of an event. For instance, if a value of an applied force to the assistive support device is greater than or less than a threshold value of an applied force, then feedback component 130 can provide feedback to a user indicating the occurrence of forces outside the threshold amounts. For instance, if a user applies a threshold force to the cane (e.g., a maximum level of force) that is associated with an undesirable displacement of body weight by the user, then the feedback mechanism can notify a user of such undesirable displacement. Thus, the feedback mechanism can provide useful information to a user to adjust their use behavior. Other such useful information can include, average velocity of patient using the cane (e.g., foot/second), average momentum, cane contact time with a surface (e.g., in seconds), cane brake impulse, or cane acceleration impulse. All such information can provide details as to the displacement patterns of the body and cane shaft during walking or standing.

The feedback component 130 can use numerous haptic cues derived from an assistive support device such as a cane to provide feedback. In an aspect, various postural responses of a cane user can be correlated with voluntary arm movements of the user. The feedback component 130 can provide more than one feedback mechanism to a user to initiate behavioral changes. For instance, a vibration at a certain portion of the handle can indicate to a user to hold the cane vertically rather than at a slant. Another feedback mechanism such as a pulsed rhythmic vibration or light blinking can indicate that the patients' body is swaying or rocking while using the cane and indicates the patient should adjust their posture. In an instance, a blind user could feel a patterned stimulation across their palm while holding the cane to indicate various feedback information. The feedback mechanism can make use of correlations, such as correlations between a center of pressure displacement throughout the cane and lateral cane force, cane orientation and forces exerted throughout a cane, and other such correlations to provide meaningful user feedback (e.g., about proper or improper usage patterns, etc.).

In another aspect, the integration of force feedback and mechanical dynamics can assist users in training to better use an assistive support device. For instance, an elderly person with a history of falls can be trained to enhance their postural stability under conditions of postural perturbances based on the feedback data. For example, indicators as to whether a users' posture (as determined by force data) should be corrected to mitigate a risk of a fall. Furthermore, feedback component 130 can provide predictive feedback as to whether a certain set of current conditions match a set of predictive conditions related to a risk of a user falling. Another, feedback can be provided to indicate as to whether the torque generated through the shaft of the cane exceeds a present threshold (e.g., an upper limit threshold or a lower limit threshold). An audio sound can be generated throughout the shaft and slowly lowered as the patient bears more weight through the limbs and less through the cane in accordance with proper cane weight distribution practices. When the weight is correctly applied the sound can be eliminated.

Figure 2:
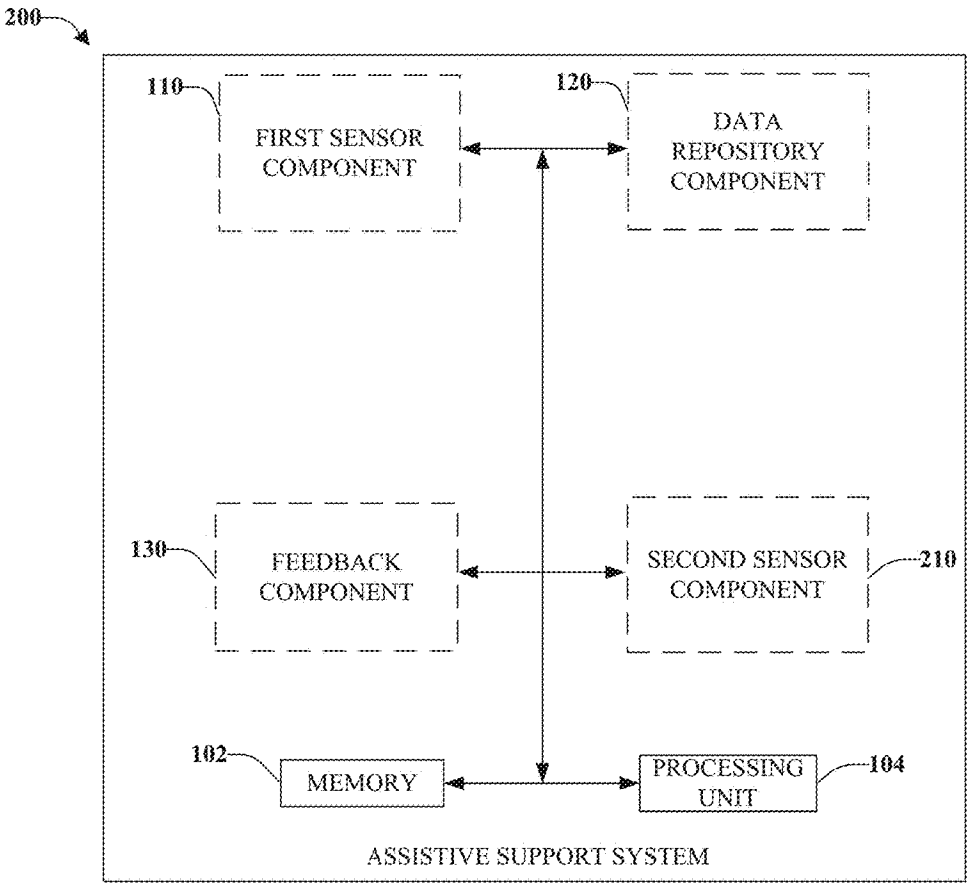
FIG. 2 illustrates an example non-limiting exemplary system for providing feedback related to using an assistive support device.

Turning now to FIG. 2, presented is another non-limiting embodiment of assistive support system 200 that provides feedback to a user in accordance with the subject disclosure. In an aspect, system 200 can comprise the components disclosed in system 100. Furthermore, system 200 can further comprise a second sensor component 210 that generates a second set of sensor data comprising a set of temperature measurements or a set of environmental pressure measurements. In an aspect, system 200 can possess numerous sensors to detect data including second sensor component 210. In an aspect, the second sensor component 210 can sense a temperature of the surrounding environment. The second sensor component 210 can detect the temperature of an outside environment and of the user itself. Furthermore, second sensor component 210 can detect barometric pressure of the outside environment as well during a patients' use of the assistive support device. The receipt of additional sensory data (e.g., using second sensor component 210) can facilitate the correlation of various data points (e.g., using feedback component 130) in order to provide meaningful information to users.

For instance, environmental temperature data corresponding to use of a cane in connection with load or weight data can provide insight as to a patients posture or weight distribution during usage of a cane during winter months as opposed to summer months. Patients, users, and providers can use such information to adjust usage of the device, treatment regiments, or suggest training exercises. Thus, in an aspect, second sensor component 210 can be a multipurpose sensor or comprise multiple sensors that measure humidity, temperature, vibration (e.g., using inclinometers, tilt sensors, magneto-resistive sensors, etc.), pressure, motion, rotation, strain, impact, force or load. Furthermore, such sensors can be utilized in facilitating health and wellness monitoring, safety monitoring, rehabilitation progress monitoring, and assessment of treatment efficacy as well as calibrating other sensors.

Figure 3:
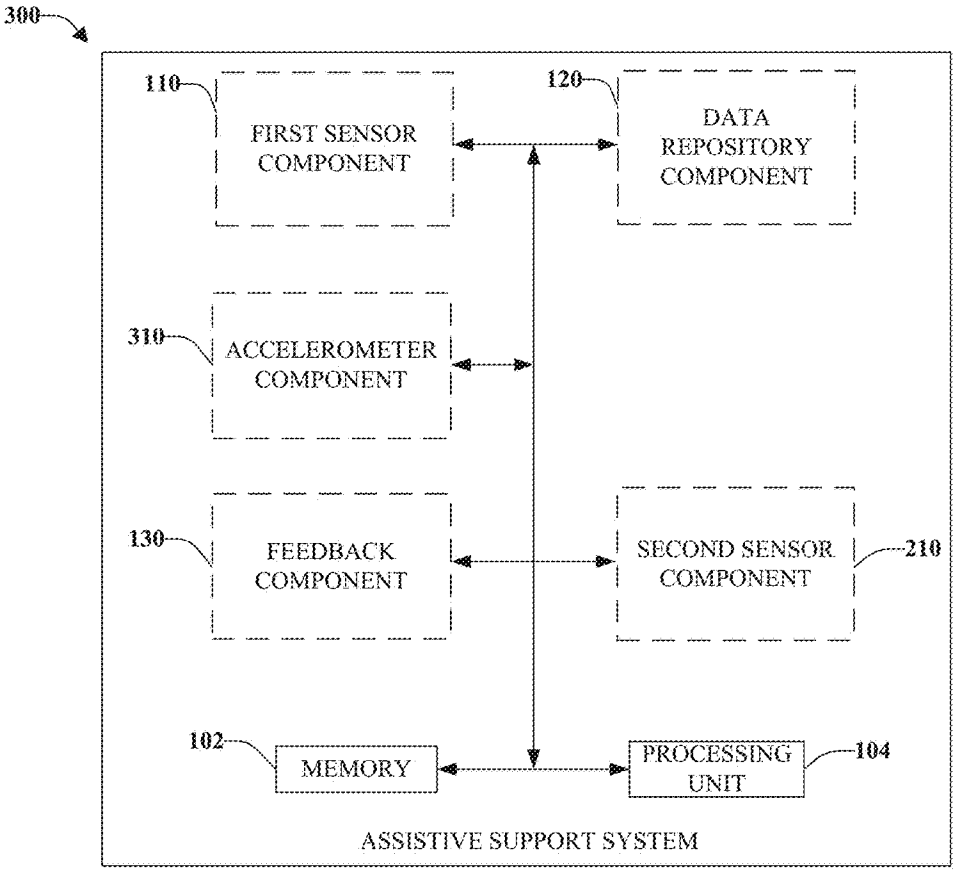
FIG. 3 illustrates an example non-limiting exemplary system for providing feedback related to using an assistive support device.

Turning now to FIG. 3, presented is another non-limiting embodiment of assistive support system 300 that provides feedback to a user in accordance with the subject disclosure. In an aspect, system 300 employs an accelerometer component 310 that detects an orientation of the assistive support device and a corresponding angle of impact of an object that applies force to the assistive support device. In an aspect, an accelerometer can detect the acceleration (e.g., linear acceleration, non-linear acceleration) of the assistive support device. The accelerometer can also measure and analyze (e.g., using feedback component 310) vibration or shock incurred throughout the assistive support device. In an aspect, a jerking motion can activate the accelerometer component 310 during movement of the device (e.g., swinging of a cane) from a patients' usage.

The accelerometer component 310 can be any of a variety of accelerometers that vary in size, sensitivity, accuracy, and provide different sampling rates (e.g., piezoelectric, capacitance, null-balance, strain gauge, resonance, piezoresistive induction, and magnetic induction). In an aspect, the accelerometer component 310 can measure in three axes (e.g., multiple axes all orthogonal to each other) using a tri-axial accelerometer. In another aspect, the accelerometer can be mounted within the handle of an assistive support device. In another aspect, accelerometer component 310 can be utilized in connection with a gyroscope to detect the movement of the assistive support device (e.g., angular velocity of the device) as a result of forces exerted throughout the assistive support device. The gyroscope can also be enclosed within the handle of the assistive support device. In yet another aspect, the accelerometer component 310, gyroscope, first sensor component 110, and second sensor component 210 can all emit signals that are received by feedback component 130 and translated from signal data to meaningful user feedback data.

Figure 4:
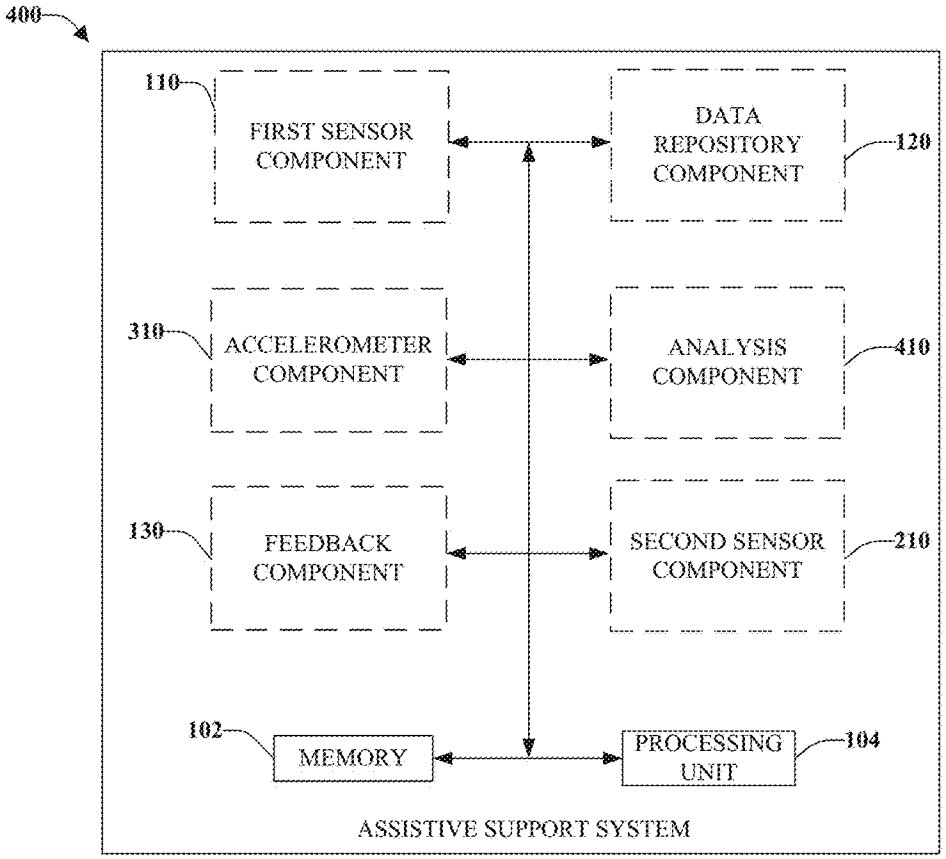
FIG. 4 illustrates an example non-limiting exemplary system for providing feedback related to using an assistive support device.

Turning now to FIG. 4, presented is another non-limiting embodiment of assistive support system 400 that provides feedback to a user in accordance with the subject disclosure. In an aspect, system 400 further comprises an analysis component 410 that translates a set of user data, the first set of sensor data, or the second set of sensor data into user feedback data comprising at least one of a set of hand grip data, pulse data, heart rate data, or biometric data. In an aspect, data generated by the sensors (e.g., first sensor component 110, second sensor component 210, accelerometer component 310, gyroscope, etc.) can be translated into meaningful data. In an aspect, hand grip data can comprise quantifying the strength of a grip by measuring the amount of static force applied by a hand squeezing around a cane handle (e.g., the strength can be measured via a dynamometer) embedded within the handle or other type of force sensor. In an aspect, the first set of sensor data can comprise a step count comprising a number of steps or a movement speed.

In another aspect, the pulse data can comprise heart rate data such as heart rate zones, resting heart rate, maximum heart rate, and other such heart data. A patient knowing their heart rate while using the digital cane device can know how intense they are working or exercising in using the device. Biometric feedback can utilize recognition data to login to system 100 employed by the device. For instance, a biometric finger scan, facial recognition, retinal recognition, fingerprint recognition, voice recognition, gait recognition (e.g., behavioral biometric that uses an individuals walking style or gait to determine identity) can all be used to login to system 400 and identify the user and their set of usage pattern data. In another aspect, signal data, force data, motion data, rotational force data, orientation data, device characteristic data, angle data, swing data, and so on related to usage of an assistive support device can be translated into usage pattern data related to the device. Furthermore, such information and data can be used by physicians to provide patient recommendations, therapists to enhance therapeutic and training exercises, as well as the user to adjust their usage of the device based on feedback or mitigate accidents while using the device (e.g., prevent or predict falls from using the device).

Figure 5:
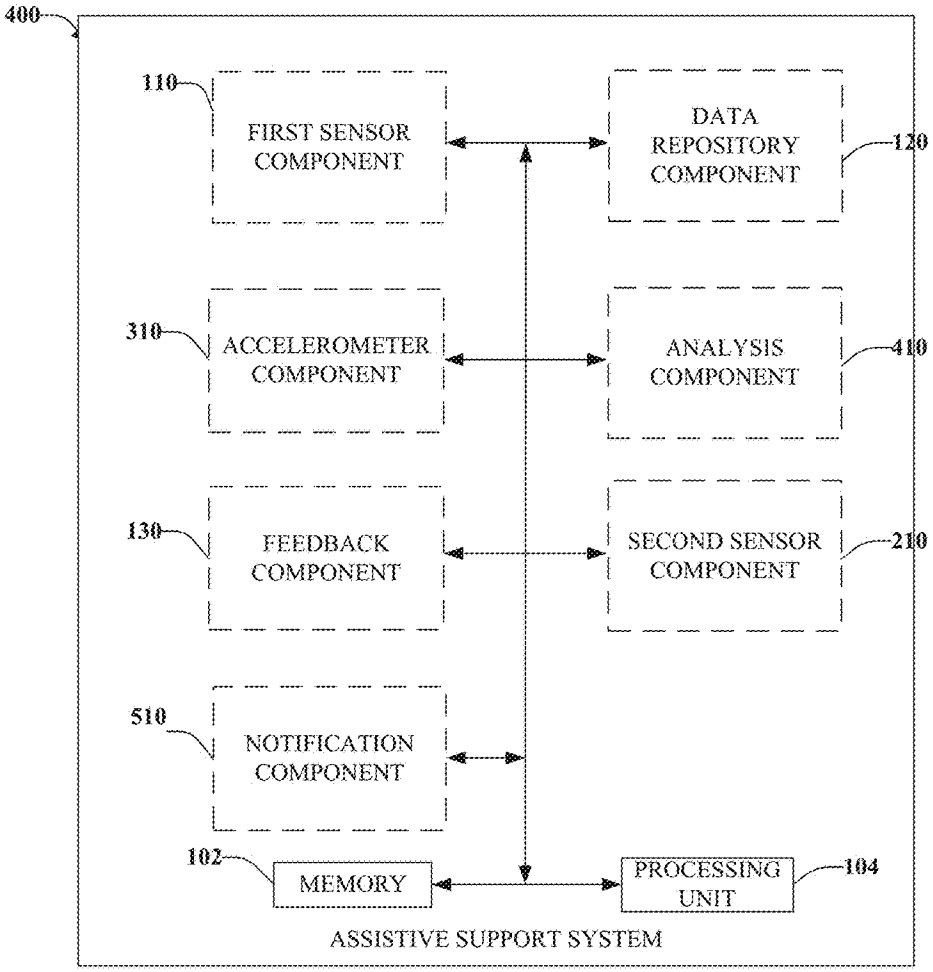
FIG. 5 illustrates an example non-limiting exemplary system for providing feedback related to using an assistive support device.

Turning now to FIG. 5, presented is another non-limiting embodiment of assistive support system 500 that provides feedback to a user in accordance with the subject disclosure. In an aspect, system 500 further comprises a notification component 510 that notifies a remote device of a set of activity corresponding to the assistive support device. In an aspect, notification component 510 can notify a remote device or the occurrence of an event based on the feedback data. For instance, notification component 510 can send a notification to a mobile device, tablet, desktop computer, laptop computer, pager, computing device, set top box or other such computing device. In an aspect, a family member, caregiver, healthcare provider or other relevant person may be notified via a remote device of an activity or situation that occurs in relation to usage of the device.

For instance, a clinical physician can remotely monitor a patients' status and be alerted if a medical decision should be made with respect to using the device. Thus a person of interest to the user can monitor movement data and physiological data by other devices. In an aspect, a person such as a home nurse or caretaker at an assisted living facility can perform long term monitoring of a patients' status in the home or community. In another aspect, the remote device receiving notifications can be an external server (e.g., hospital server, healthcare facility server, etc.) or mobile phone.

Figure 6:
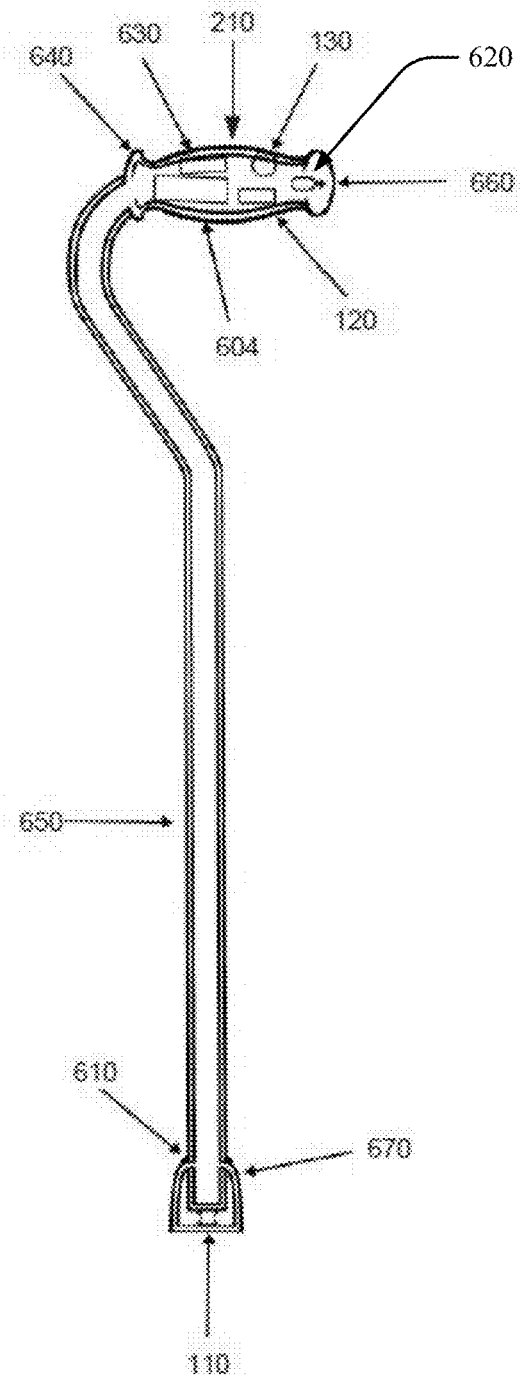
FIG. 6 illustrates an example non-limiting exemplary diagram of an assistive support device that provides user feedback.

Turning now to FIG. 6, presented is a non-limiting example digital assistive support device 600 that provides feedback information. In an aspect; device 600 comprises a memory 102 to store computer-executable components; a processor 104, communicatively coupled to the memory 102, that executes or facilitates execution of one or more computer-executable instructions; a base element 610 extending from a bottom portion of a hollow shaft 650, wherein the base element 610 comprises a first set of sensors that detects a first set of data representing a first set of force values applied to the base element 610 of the device; a transmission component 620 that transmits the first set of data to a microcontroller element 630; and a handle element 640 extending from a top portion of the hollow shaft 650, wherein the handle element 640 encapsulates the microcontroller element 630 that analyzes the first set of data, the memory 102, and the processor 104.

In an aspect, device 600 comprises a base element 610 comprising an embedded force sensor (e.g., using first sensor component 110) to detect device use pattern data including, but not limited to, data from an amount of load or force applied to force sensor. Furthermore, in an aspect, transmission component 620 transmits the first set of data to a microcontroller element 630 encapsulated in the handle element 640. In an aspect, the microcontroller element 630 comprises mixed signal processors that can facilitate the measuring, monitoring, and displaying (e.g., by employing amplification, filtering, and measured usage) data (e.g., data generated from sensor signals) such as force data applied to the device. In an aspect microcontroller element 630 can facilitate increased processing performance at low supply currents.

In another aspect, the handle element 640 can comprise a force sensor (e.g., using second sensor component 130) to detect pressure applied by a users grip of the handle. Furthermore, in an aspect, handle element 640 can encapsulate the processor 104, memory 102, an accelerometer, a gyroscope and other such mechanical components of the device. The sensors embedded within the handle element 640 can communicate with the microcontroller element 630 via Bluetooth, wireless technology, or signal transmission techniques.

In another aspect, a power source 604, such as a battery (e.g., lithium ion, standard voltage battery, etc.), solar cell, electrical socket, and other such power source can be incorporated into device 600 at various locations such as within the handle element 640, hollow shaft 650. Furthermore, device 600 can further comprise a data port 660 within the handle element 640 (or at other locations within the device 600). For instance, the data port 660 can be a USB port that interfaces with a USB storage device to facilitate the exchange of data in a plug and play nature. In addition to a wired connectivity, device 600 can comprise a wireless exchange of data as well. For instance, an aspect of the storage of data and/or computation can be cloud based and universally accessible. Thus, larger quantities of data can be managed and processed to generate clinically relevant information. As such, device 600 via a data port 660 or wireless connection (e.g., Wi-Fi, Bluetooth, GPRS, etc.) can communicate with a mobile health appliance and via the internet can communicate with healthcare providers, wellness coaches, personal health record systems (e.g., EMR's), caretakers and family members. Device 600 can also communicate via Bluetooth with personal devices, wearable sensors, and relevant infrastructure networks.

In yet another aspect, device 600 can comprise a rubber cap element 670 at the base of the device to provide stability and encase first sensor element 110 encased. In another aspect, second sensor element 210 can be located in a variety of positions throughout the device including on the handle element 640 and measure a variety of parameters (e.g., strain, pressure, orientation, temperature, biological vitals, heart rate, rotation, impact, location, load, motion, force, motion, rotational force, acceleration, walking speed, inactivity of device, angular velocity, tilt of the device, etc.). Furthermore, in an aspect, the handle element 640 can comprise a display component such as an LED screen to display data via a graphical user interface. The device can also communicate with external devices (E.g., mobile device) and utilize the display at the external device to present data.

Thus, in a non-limiting embodiment, device 600 can facilitate providing feedback information to a patient using the device 600. In an aspect, device 600 comprises a hollow shaft 650 with embedded electronics. In an aspect, a first sensor component 110 is placed at the bottom portion of the hollow shaft 650 between a cap 670 (e.g., comprising a rubber material) and a metal layer of the device 600. In another aspect, weather and water resistant sealant can be applied to the edge of the cap 670 and the base element 610 to protect the first sensor component 110 from water damage.

The first sensor component 110 is connected to a microcontroller element 630 located within or atop the handle element 640. In an aspect, microcontroller element 630 monitors the values outputted by the first sensor component 110. If the values are in excess or less than the acceptable values programmed by a person such as a doctor or therapy technician, microcontroller element 630 applies power to a method of feedback to the patient located in the handle element 640. Feedback may include, but is not limited to, a vibration motor and/or an LED bulb. This will notify the patient whether the force observed by the first sensor component 110 is within the range set by the doctor. Various methods of notification can be implemented, such as a notification when the force is too great and/or a notification when the force is insufficient.

In an aspect, an implementation of a notification can be constant vibrate, pulsed vibrate, constant light illuminated, blinking light, or any combination of such implementations. Also, multiple colored lights (e.g., via LED) can be implemented to indicate various usage patterns or the occurrence of triggering events. Furthermore, in another aspect, feedback can be implemented via a sound or noise. The data from the first sensor component 110 would also be recorded to a data repository or memory 102 located in handle element 640. This will allow the administrator such as a doctor or physical therapy technician to observe past data between sessions. Because the administrator can access this information, they can further direct the patient to help them recover properly.

In another aspect, device 600 can comprise a power source 604 to power the electronics, and the power source 604 can be located in handle element 640. The power source 604 can be charged and the data from the memory 102 accessed through data port 660 located at the end of handle element 640. In an aspect, data port 660 can also facilitate a programming of device 600 to react to force data that are generated (e.g., using first sensor component 110 and second sensor component 120) based on forces detected by the sensors within a range of acceptable forces. The programming can include programming an upper and lower limit of acceptable weight to be applied to device 600 based on the patients' circumstances. Also, new firmware updates (e.g. to microcontroller element 630) can be applied to device 600, a user view of data from between sessions that are stored in memory 102 of device 600, and a software that facilitates the wireless presentation in real-time of weight sensed by sensors can all be presented at a display component of device 600.

In a non-limiting example, device 600 can be provided by a doctor or physical therapist to the patient. After explaining how the device 600 works, the doctor would connect the device 600 to a computer or other electronic device and upload the acceptable range of forces to device 600. The patient is then given the device, which can be a digital cane. As the patient walks around, the cane collects the force data constantly. Only if the force exceeds some minimum value could the feedback sensor become active. This is to prevent the cane from always vibrating when no force is being applied or when the cane is simply standing under its own weight.

If the force sensed exceeds, for example, 10 lbs, it is evident that the patient is applying weight downwards. Then, by observing the maximum value of the force in each no pressure-pressure-no pressure cycle, the microcontroller (e.g., using microcontroller element 630) will be able to determine if the maximum force measured is within the range set by the doctor. If it is less than the set range, the vibration motor will pulse vibrate for a short interval. If the sensed value is within the range, the cane does not provide any feedback. If the sensed value is higher than the allowable range, the vibration motor will sustain vibrate for a short interval. As the patient walks, they will be given one of three signals as feedback (e.g., using feedback component 120): too much force, correct amount of force, or too little force. This data is also collected and stored in a storage unit (e.g., memory 102) in handle element 640. When the patient returns to the physical therapist's office, the technician will download the prior data from the cane to their computer to observe the force data from the interim time. This would allow the physician or technician to further detail the proper way to apply force through the injured limb.

A non-limiting example of how the device can work in an instance is now described. A physician determines the ideal range for weight to be applied to the device 600 is 15-25 lbs. The physician can program the values (e.g. using a control panel of the device) into the device 600 and provide device 600 to the patient. As the patient walks using device 600, the patient places some amount of force through the device 600. The first sensor component 110 at the bottom detects the actual force transmitted through the cane and relays that information to the microcontroller element 630. In this example; the force detected is 20 lbs. When the microcontroller element 630 receives this information, it is compared to the preset limits (15-25 lbs) as programmed by the physician to be an acceptable range of force to be applied to device 600.

Because the current force (20 lbs) is within the patient's acceptable limits (15-25 lbs), the device 600 does not provide any feedback. In the event the patient does not apply enough force through the device 600, for instance, the sensor only detects 10 lbs, then this information is again relayed to microcontroller element 630. The information is again compared to the acceptable range of values provided by the physician. Because the actual force applied is lower than the lower limit (15 lbs) of the prescribed forces programmed by the physician, the device 600 needs to provide feedback to the user to indicate they are not applying enough force to device 600.

In an aspect, a vibration pattern similar to a solid vibrate can be employed by device 600 (e.g. the handle element 640 vibrates). The vibration can thus notify the patient that the weight applied to the device 600 is insufficient. In another aspect, the patient can apply too much weight to the device 600, for instance, if the patient applies a large force of 30 lbs to device 600. This information is relayed to the microcontroller element 630, which determines that the applied force is outside the upper limit of force (25 lbs) prescribed by the physician. The microcontroller element 630 can notify the user using a different pattern than before. For example, a pulsating pattern of vibrate (on-off-on-off-on- . . . ) may be employed to allow the patient to understand that the device 600 is sensing too much weight. Based on the feedback, the patient can adjust their behavior accordingly to apply the prescribed force to device 600.

In an alternative embodiment, a smart phone application may also be used to observe, collect or even signal to the patient. In this case, first sensor component 110 in the device 600 will transmit the sensed value to a wireless transmitter. This can then transmit the data to a mobile phone or other external electronic device. The device can process if the value is within or outside the range and vibrate itself. In an instance, first sensor component 110, wireless transmitter, and battery are inside the device 600.

In another alternative embodiment, the electronic mechanism and associated sensors and overall system 500 can be directly incorporated into soles of shoes. They may use wireless technologies such as Wi-Fi or Bluetooth to transfer data from the cane (e.g., device 600), shoes, or other device to a computer.

In another aspect, device 600 can comprise handle element 640 that further comprises a second set of sensors that generate a second set of data representing a set of hand information. Furthermore, in another aspect, the set of hand information can comprise handgrip data, pulse data, heart rate data, and other biometric data. Furthermore, in an aspect, microcontroller element 630 can further employ an assessment component that compares the first set of data to a set of reference data representing a prescribed set of force values. Also, in an aspect, device 600 can comprise feedback component that presents a set of information to a user based on usage of the device. In yet another aspect, the set of information can be based on a comparison of the first set of data to the set of reference data. Furthermore, in an aspect, handle element 640 can employ a response component that activates an indicator signal of the device based on an occurrence of a triggering event, wherein the indicator element comprises at least one of a vibration, sounds, or light emission.

Figure 7:
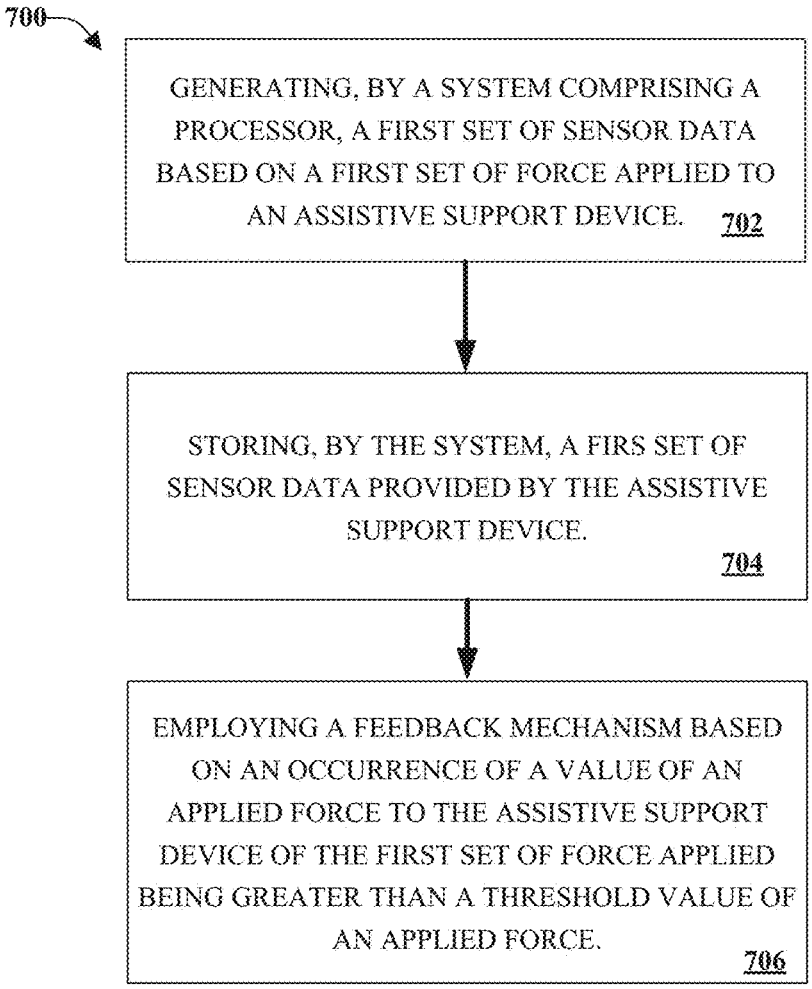
FIG. 7 illustrates an example non-limiting methodology for providing user feedback using an assistive support device.
Figure 8:
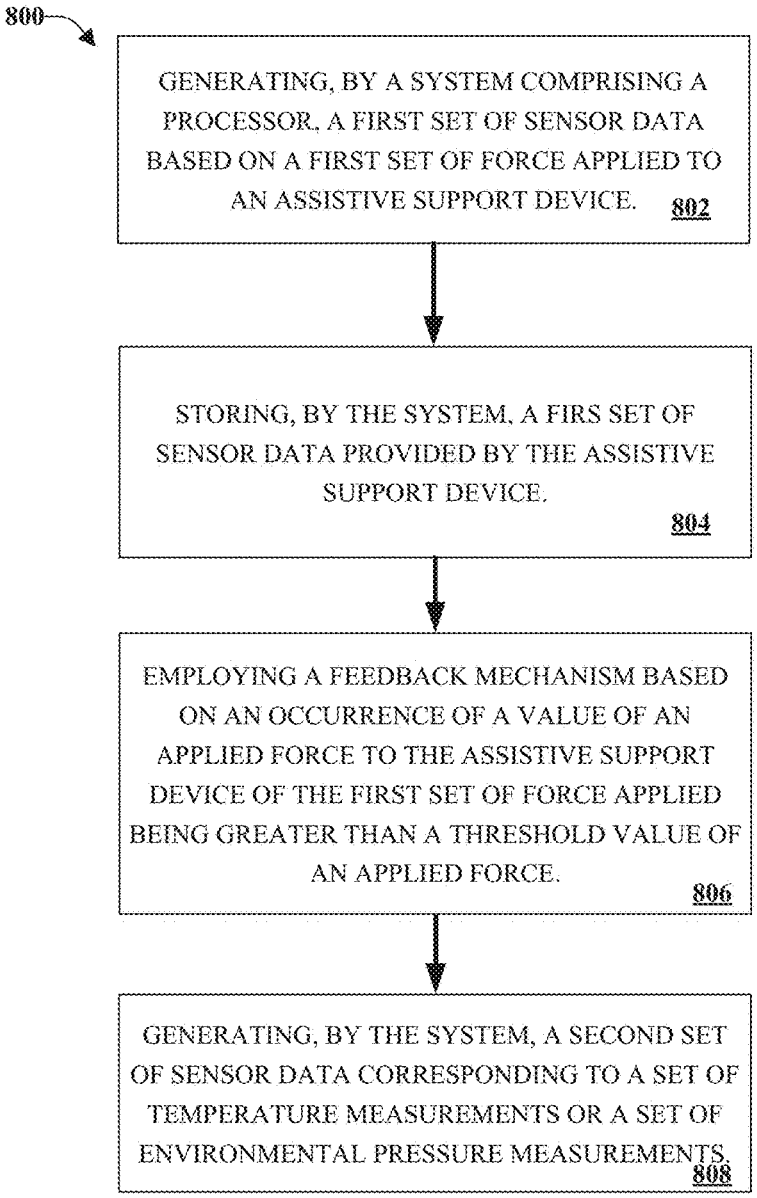
FIG. 8 illustrates an example non-limiting methodology for providing user feedback using an assistive support device.
Figure 9:
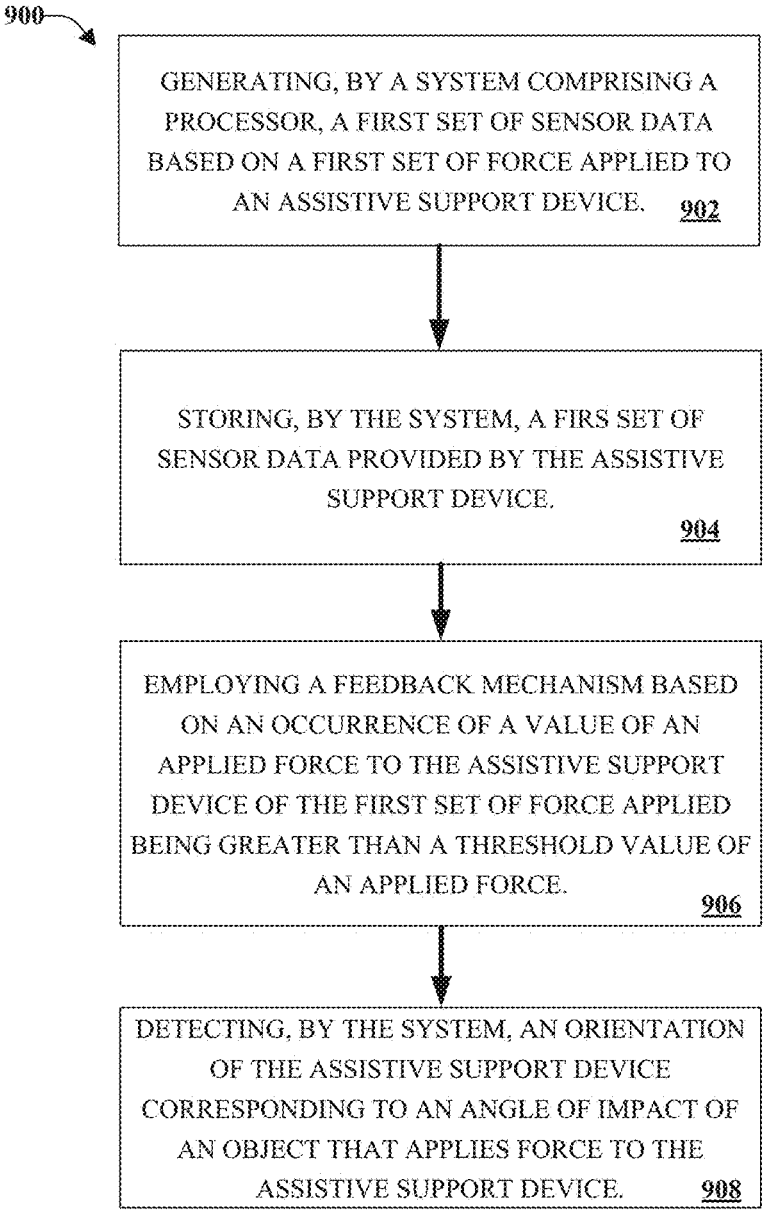
FIG. 9 illustrates an example non-limiting methodology for providing user feedback using an assistive support device.

In view of the example systems and/or devices described herein, example methods that can be implemented in accordance with the disclosed subject matter can be further appreciated with reference to flowcharts in FIGS. 7-9. For purposes of simplicity of explanation, example methods disclosed herein are presented and described as a series of acts; however, it is to be understood and appreciated that the disclosed subject matter is not limited by the order of acts, as some acts may occur in different orders and/or concurrently with other acts from that shown and described herein.

For example, a method disclosed herein could alternatively be represented as a series of interrelated states or events, such as in a state diagram. Moreover, interaction diagram(s) may represent methods in accordance with the disclosed subject matter when disparate entities enact disparate portions of the methods. Furthermore, not all illustrated acts may be required to implement a method in accordance with the subject specification. It should be further appreciated that the methods disclosed throughout the subject specification are capable of being stored on an article of manufacture to facilitate transporting and transferring such methods to computers for execution by a processor or for storage in a memory.

FIG. 7 illustrates a flow chart of an example method 700 for providing feedback to a user using an assistive support device. At 702, a first set of sensor data is generated (e.g., using first sensor component 110) based on a first set of force applied to an assistive support device. At 704, a first set of sensor data provided by the assistive support device is stored (e.g., using memory 102). At 706, a feedback mechanism is employed based on an occurrence of a value of an applied force to the assistive support device of the first set of force applied being greater than a threshold value of an applied force.

FIG. 8 illustrates a flow chart of an example method 800 for providing feedback to a user using an assistive support device. At 802, a first set of sensor data is generated (e.g., using first sensor component 110) based on a first set of force applied to an assistive support device. At 804, a first set of sensor data provided by the assistive support device is stored (e.g., using memory 102). At 806, a feedback mechanism is employed based on an occurrence of a value of an applied force to the assistive support device of the first set of force applied being greater than a threshold value of an applied force. At 808, a second set of sensor data corresponding to a set of temperature measurements or a set of environmental pressure measurements are generated.

FIG. 9 illustrates a flow chart of an example method 900 for providing feedback to a user using an assistive support device. At 902, a first set of sensor data is generated (e.g., using first sensor component 110) based on a first set of force applied to an assistive support device. At 904, a first set of sensor data provided by the assistive support device is stored (e.g., using memory 102). At 906, a feedback mechanism is employed based on an occurrence of a value of an applied force to the assistive support device of the first set of force applied being greater than a threshold value of an applied force. At 908, a remote device of a set of activity corresponding to a set of activity of the assistive support device is notified (e.g., using notification component 510).

Figure 10:
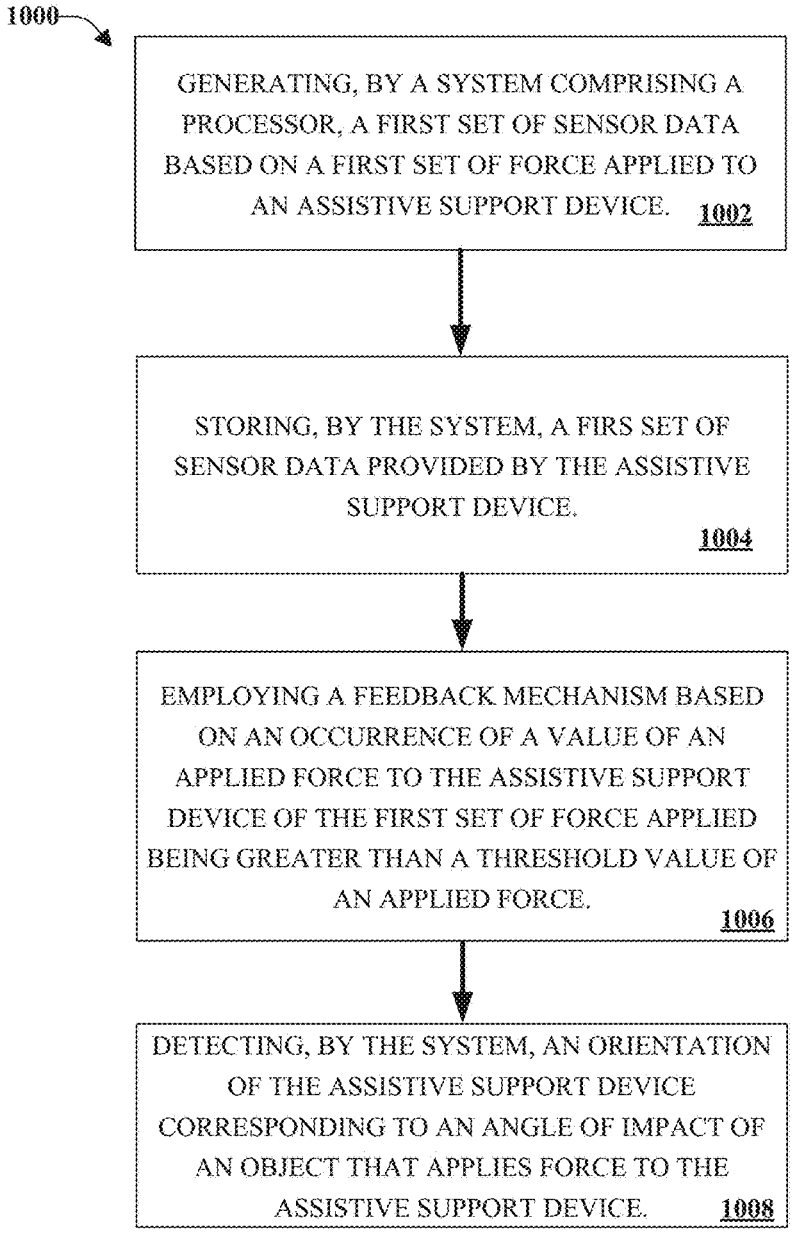
FIG. 10 illustrates an example non-limiting methodology for providing user feedback using an assistive support device.

FIG. 10 illustrates a flow chart of an example method 800 for providing feedback to a user using an assistive support device. At 1002, a first set of sensor data is generated (e.g., using first sensor component 110) based on a first set of force applied to an assistive support device. At 1004, a first set of sensor data provided by the assistive support device is stored (e.g., using memory 102). At 1006, a feedback mechanism is employed based on an occurrence of a value of an applied force to the assistive support device of the first set of force applied being greater than a threshold value of an applied force. At 1008, an orientation of the assistive support device corresponding to an angle of impact of an object that applies force to the assistive support device is detected.

Example Operating Environments

The systems and processes described below can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated in this disclosure.

Figure 11:
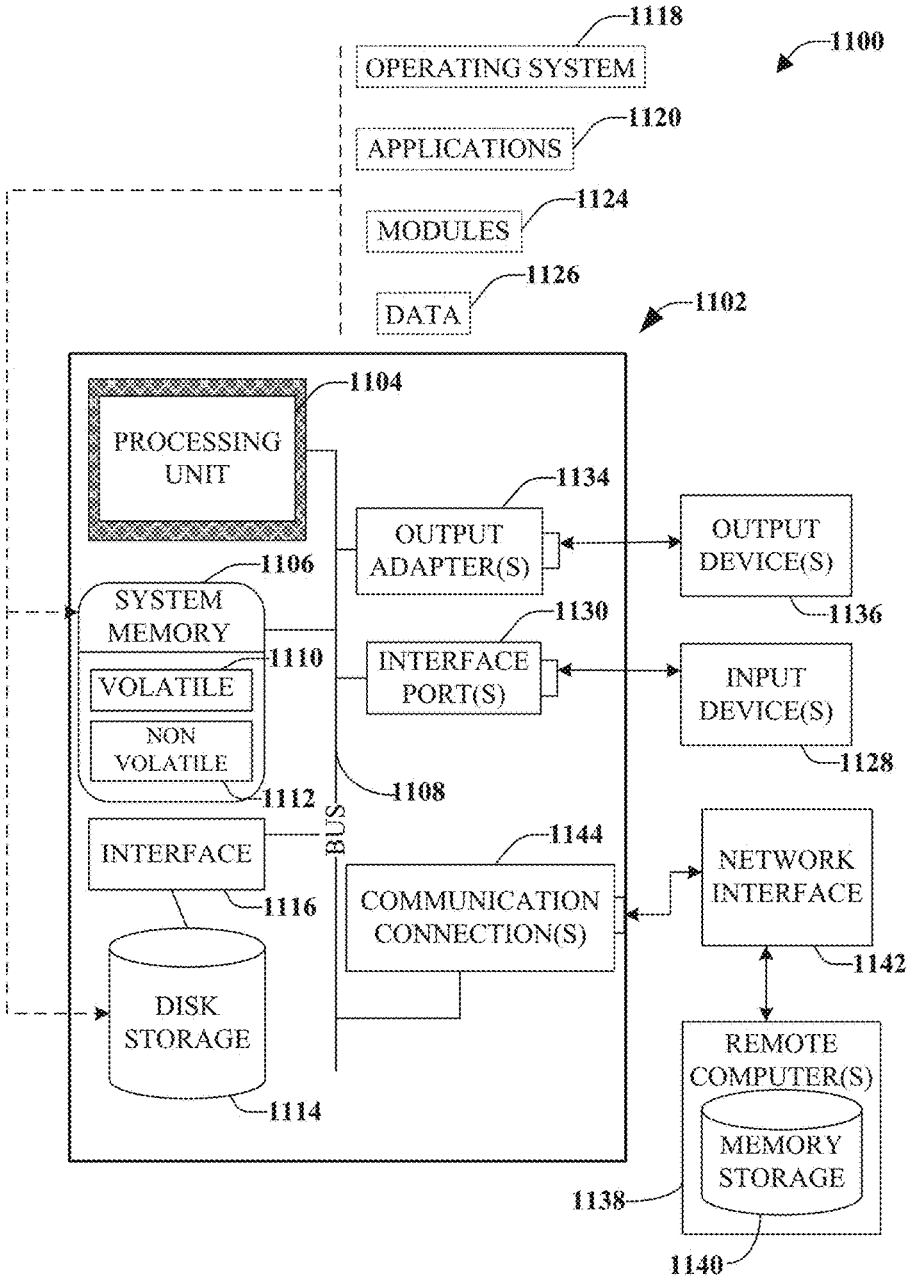
FIG. 11 is a block diagram representing an exemplary non-limiting networked environment in which the various embodiments can be implemented.

With reference to FIG. 11, a suitable environment 1100 for implementing various aspects of the claimed subject matter includes a computer 1102. The computer 1102 includes a processing unit 1104, a system memory 1106, a codec 1105, and a system bus 1108. The system bus 1108 couples system components including, but not limited to, the system memory 1106 to the processing unit 1104. The processing unit 1104 can be any of various available suitable processors. Dual microprocessors and other multiprocessor architectures also can be employed as the processing unit 1104.

The system bus 1108 can be any of several types of suitable bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Fire wire (IEEE 10104), and Small Computer Systems Interface (SCSI).

The system memory 1106 includes volatile memory 1110 and non-volatile memory 1112. The basic input/output system (BIOS), containing the basic routines to transfer information between elements within the computer 1102, such as during start-up, is stored in non-volatile memory 1112. In addition, according to present innovations, codec 1105 may include at least one of an encoder or decoder, wherein the at least one of an encoder or decoder may consist of hardware, a combination of hardware and software, or software. Although, codec 1105 is depicted as a separate component, codec 1105 may be contained within non-volatile memory 1112. By way of illustration, and not limitation, non-volatile memory 1112 can include read only memory (ROM), programmable ROM (PROM), electrically programmable ROM (EPROM), electrically erasable programmable ROM (EEPROM), or flash memory. Volatile memory 1110 includes random access memory (RAM), which acts as external cache memory. According to present aspects, the volatile memory may store the write operation retry logic (not shown in FIG. 11) and the like. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM.

Computer 1102 may also include removable/non-removable, volatile/non-volatile computer storage medium. FIG. 11 illustrates, for example, disk storage 1114. Disk storage 1114 includes, but is not limited to, devices like a magnetic disk drive, solid state disk (SSD) floppy disk drive, tape drive, Jaz drive, Zip drive, LS-70 drive, flash memory card, or memory stick. In addition, disk storage 1114 can include storage medium separately or in combination with other storage medium including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1114 to the system bus 1108, a removable or non-removable interface is typically used, such as interface 1116.

It is to be appreciated that FIG. 11 describes software that acts as an intermediary between users and the basic computer resources described in the suitable operating environment 1100. Such software includes an operating system 1118. Operating system 1118, which can be stored on disk storage 1114, acts to control and allocate resources of the computer system 1102. Applications 1120 take advantage of the management of resources by operating system 1118 through program modules 1124, and program data 1126, such as the boot/shutdown transaction table and the like, stored either in system memory 1106 or on disk storage 1114. It is to be appreciated that the claimed subject matter can be implemented with various operating systems or combinations of operating systems.

A user enters commands or information into the computer 1102 through input device(s) 1128. Input devices 1128 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1104 through the system bus 1108 via interface port(s) 1130. Interface port(s) 1130 include, for example, a serial port, a parallel port, a game port, and a universal serial bus (USB). Output device(s) 1136 use some of the same type of ports as input device(s). Thus, for example, a USB port may be used to provide input to computer 1102, and to output information from computer 1102 to an output device 1136. Output adapter 1134 is provided to illustrate that there are some output devices 1136 like monitors, speakers, and printers, among other output devices 1136, which require special adapters. The output adapters 1134 include, by way of illustration and not limitation, video and sound cards that provide a means of connection between the output device 1136 and the system bus 1108. It should be noted that other devices and/or systems of devices provide both input and output capabilities such as remote computer(s) 1138.

Computer 1102 can operate in a networked environment using logical connections to one or more remote computers, such as remote computer(s) 1138. The remote computer(s) 1138 can be a personal computer, a server, a router, a network PC, a workstation, a microprocessor based appliance, a peer device, a smart phone, a tablet, or other network node, and typically includes many of the elements described relative to computer 1102. For purposes of brevity, only a memory storage device 1140 is illustrated with remote computer(s) 1138. Remote computer(s) 1138 is logically connected to computer 1102 through a network interface 1142 and then connected via communication connection(s) 1144. Network interface 1142 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1144 refers to the hardware/software employed to connect the network interface 1142 to the bus 1108. While communication connection 1144 is shown for illustrative clarity inside computer 1102, it can also be external to computer 1102. The hardware/software necessary for connection to the network interface 1142 includes, for exemplary purposes only, internal and external technologies such as, modems including regular telephone grade modems, cable modems and DSL modems, ISDN adapters, and wired and wireless Ethernet cards, hubs, and routers.

Figure 12:
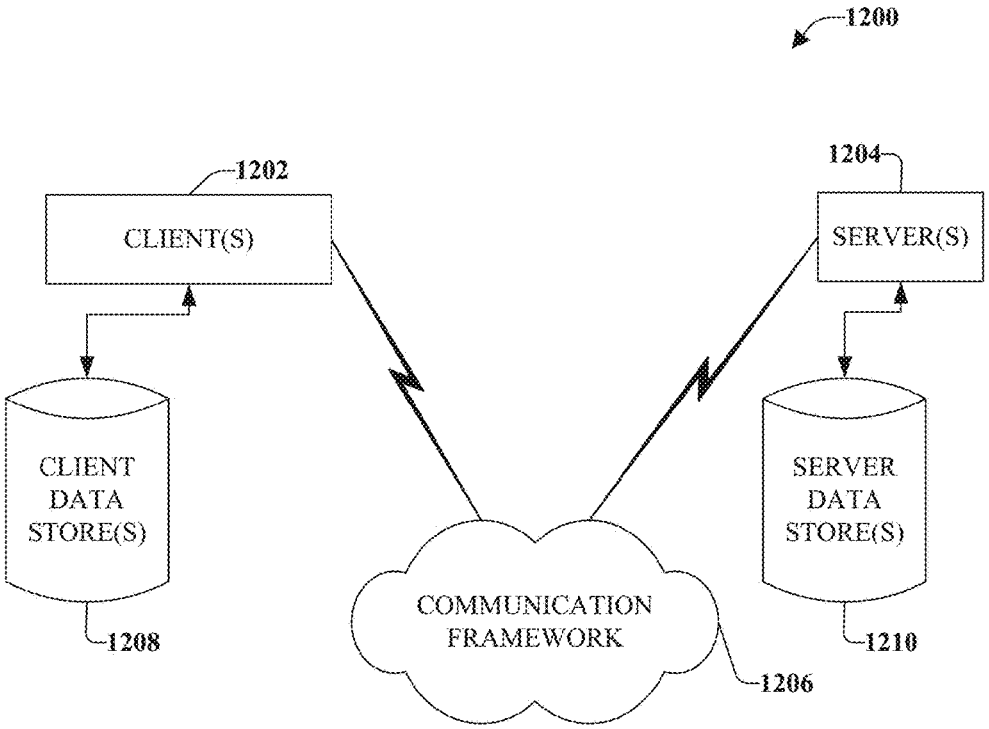
FIG. 12 is a block diagram representing an exemplary non-limiting computing system or operating environment in which the various embodiments may be implemented.

Referring now to FIG. 12, there is illustrated a schematic block diagram of a computing environment 1200 in accordance with this disclosure. The system 1200 includes one or more client(s) 1202 (e.g., laptops, smart phones, PDAs, media players, computers, portable electronic devices, tablets, and the like). The client(s) 1202 can be hardware and/or software (e.g., threads, processes, computing devices). The system 1200 also includes one or more server(s) 1204. The server(s) 1204 can also be hardware or hardware in combination with software (e.g., threads, processes, computing devices). The servers 1204 can house threads to perform transformations by employing aspects of this disclosure, for example. One possible communication between a client 1202 and a server 1204 can be in the form of a data packet transmitted between two or more computer processes wherein the data packet may include video data. The data packet can include a metadata, e.g., associated contextual information, for example. The system 1200 includes a communication framework 1206 (e.g., a global communication network such as the Internet, or mobile network(s)) that can be employed to facilitate communications between the client(s) 1202 and the server(s) 1204.

Communications can be facilitated via a wired (including optical fiber) and/or wireless technology. The client(s) 1202 include or are operatively connected to one or more client data store(s) 1208 that can be employed to store information local to the client(s) 1202 (e.g., associated contextual information). Similarly, the server(s) 1204 are operatively include or are operatively connected to one or more server data store(s) 1210 that can be employed to store information local to the servers 1204.

In one embodiment, a client 1202 can transfer an encoded file, in accordance with the disclosed subject matter, to server 1204. Server 1204 can store the file, decode the file, or transmit the file to another client 1202. It is to be appreciated, that a client 1202 can also transfer uncompressed file to a server 1204 and server 1204 can compress the file in accordance with the disclosed subject matter. Likewise, server 1204 can encode video information and transmit the information via communication framework 1206 to one or more clients 1202.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described in this description can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described in this disclosure for illustrative purposes, various modifications are possible that are considered within the scope of such embodiments and examples, as those skilled in the relevant art can recognize.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the disclosure illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described in this disclosure may also interact with one or more other components not specifically described in this disclosure but known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable storage medium; software transmitted on a computer readable transmission medium; or a combination thereof.

Moreover, the words "example" or "exemplary" are used in this disclosure to mean serving as an example, instance, or illustration. Any aspect or design described in this disclosure as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used in this description differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

In view of the exemplary systems described above, methodologies that may be implemented in accordance with the described subject matter will be better appreciated with reference to the flowcharts of the various figures. For simplicity of explanation, the methodologies are depicted and described as a series of acts. However, acts in accordance with this disclosure can occur in various orders and/or concurrently, and with other acts not presented and described in this disclosure. Furthermore, not all illustrated acts may be required to implement the methodologies in accordance with certain aspects of this disclosure. In addition, those skilled in the art will understand and appreciate that the methodologies could alternatively be represented as a series of interrelated states via a state diagram or events. Additionally, it should be appreciated that the methodologies disclosed in this disclosure are capable of being stored on an article of manufacture to facilitate transporting and transferring such methodologies to computing devices. The term article of manufacture, as used in this disclosure, is intended to encompass a computer program accessible from a computer-readable device or storage media.

What is claimed is:

1. A system comprising:

a memory that stores computer executable components;

a processor that executes at least the following computer executable components stored in the memory:

a first sensor component that generates first sensor data based on a first force applied to an assistive support device;

a second sensor component that generates second sensor data based on a grip applied to a handle portion of the assistive support device;

a data repository component that stores the first sensor data provided by the assistive support device; and a feedback component that triggers a feedback mechanism based on a comparison of a first value corresponding to the first sensor data and a second value associated with second sensor data to a threshold value representing a threshold applied force.

2. The system of claim 1, wherein the threshold value can comprise an upper limit value and a lower limit value.

3. The system of claim 1, wherein the feedback mechanism comprises a vibration, a pulsed vibration, an illumination of an indicator light, a blinking of the indicator light, or an illumination of more than one light, wherein the more than one light are different colors respectively.

4. The system of claim 1, wherein the second sensor component comprises a set of temperature measurements or a set of environmental pressure measurements.

5. The system of claim 1, further comprising an accelerometer component that detects an orientation of the assistive support device or a corresponding angle of impact of an object that applies force to the assistive support device.

6. The system of claim 1, further comprising an analysis component that translates a set of user data, the first sensor data, or the second sensor data into user feedback data comprising at least one of a set of hand grip data, pulse data, heart rate data, or biometric data.

7. The system of claim 1, wherein the first sensor data comprise a step count comprising a number of steps or a movement speed.

8. The system of claim 1, further comprising a notification component that notifies a remote device of a set of activity corresponding to the assistive support device.

9. A method comprising:

generating, by a system comprising a processor, a first set of sensor data based on a first set of force applied to an assistive support device;

generating, by the system a second set of sensor data based on a grip applied to a handle portion of the assistive support device;

storing, by the system, the first set of sensor data provided by the assistive support device; and triggering, by the system, a feedback mechanism based on a comparison of a first value of the first set of sensor data and the second set of sensor data to a threshold value representing a threshold applied force.

10. The method of claim 9, wherein the second set of sensor data corresponding to a set of temperature measurements or a set of environmental pressure measurements.

11. The method of claim 9, further comprising detecting, by the system, an orientation of the assistive support device corresponding to an angle of impact of an object that applies force to the assistive support device.

12. The method of claim 9, further comprising notifying, by the system, a remote device of a set of activity corresponding to a set of activity of the assistive support device.

13. The method of claim 9, further comprising generating, by the system, a set of hand grip data, a set of pulse data, a set of heart rate data, or other biometric data.

14. A device, comprising:

a memory to store computer-executable components;

a processor, communicatively coupled to the memory, that executes or facilitates execution of one or more computer-executable instructions;

a base element extending from a bottom portion of a hollow shaft, wherein the base element comprises a first set of sensors that detects a first set of data representing a first set of force values applied to the base element of the device;

a handle element extending from a top portion of the hollow shaft, wherein the handle element comprises a second set of sensors that detect a second set of data representing a second set of force values based on a grip of the handle element, and, wherein the handle element encapsulates the microcontroller element that analyzes the first set of data, the memory, and the processor;

a transmission component that transmits the first set of data and the second set of data to a microcontroller element; and a feedback component that triggers a feedback mechanism based on a comparison of the first set of data and the second set of data to a threshold value representing a threshold applied force.

15. The device of claim 14, wherein the handle element further encapsulates an accelerometer or a gyroscope.

16. The device of claim 14, wherein the second set of data comprises at least one of hand grip data, pulse data, or heart rate data.

17. The device of claim 14, wherein the microcontroller element employs an assessment component that compares the first set of data to a set of reference data representing a prescribed set of force values.

18. The device of claim 14, wherein the feedback mechanism is a vibration and the threshold applied force corresponds to an application of excessive force or unsufficient force on the device.

19. The device of claim 18, wherein the microcontroller element employs a mixed signal processor monitors the first set of data and the second set of data.

20. The device of claim 14, wherein the handle element employs a response component that activates an indicator signal of the device based on an occurrence of a triggering event.

* * * * *